US007669506B2

(12) United States Patent
Cox

(10) Patent No.: US 7,669,506 B2
(45) Date of Patent: Mar. 2, 2010

(54) SHINGLE REMOVAL TOOL

(75) Inventor: Daniel Cox, Elon, NC (US)

(73) Assignee: Shining Golden Yida Welding & Cutting Machinery Manufacture, Ltd., Hong Kong (CN)

( * ) Notice: Subject to any disclaimer, the term of this patent is extended or adjusted under 35 U.S.C. 154(b) by 0 days.

(21) Appl. No.: 11/417,060

(22) Filed: May 4, 2006

(65) Prior Publication Data

US 2007/0256523 A1 Nov. 8, 2007

(51) Int. Cl.
*E04D 15/00* (2006.01)

(52) U.S. Cl. ..... 81/450; 254/131.5

(58) Field of Classification Search ..... 81/45, 81/46; 254/131, 131.5, 23, 24; D8/88, 89; 30/169, 170, 172
See application file for complete search history.

(56) References Cited

U.S. PATENT DOCUMENTS 1,267,915 A * 5/1918 Shellabarger ..... 294/57
3,007,581 A * 11/1961 Moore ..... 211/64
3,226,149 A * 12/1965 McJohnson ..... 294/50
D267,468 S * 1/1983 Simms ..... D8/10
4,477,972 A * 10/1984 Testa, Jr. ..... 30/172
5,471,899 A * 12/1995 Twomlow ..... 81/60
5,795,000 A * 8/1998 Aldorasi ..... 294/57
5,813,295 A * 9/1998 Jensen, Jr. ..... 81/45
6,125,720 A * 10/2000 Gohman ..... 81/45
D461,610 S 8/2002 Perelli
D468,879 S 1/2003 Perelli
6,792,829 B2 * 9/2004 Garcia et al. ..... 81/45
2005/0120831 A1 * 6/2005 Parker et al. ..... 81/45

* cited by examiner

*Primary Examiner*—Hadi Shakeri
(74) *Attorney, Agent, or Firm*—Hogan & Hartson LLP

(57) ABSTRACT

A shingle removing tool includes, among other possible things, a handle, a shaft connected to the handle, and a base connected to the shaft. A length of the shaft is adjustable. The base includes a blade portion that is configured to separate one or more shingles from a support structure to which the shingles are affixed.

15 Claims, 9 Drawing Sheets

SHINGLE REMOVAL TOOL

BACKGROUND

Previously, when removing shingles from a roof, a roofer would typically use a shovel. Specifically, the roofer would push the shovel under the shingles to pry the shingles from the roof. To facilitate this practice, some roofers have used flat bladed shovels, which place a larger amount of the shovel blade against the roof as compared to shovels that have rounded blades. Although use of flat bladed shovels has improved the shingle removing process, these shovels suffer many of the same problems known to plague the more conventional shovels that have rounded blades.

One problem that still exists is the inability of shingle removing shovels to account for the nails that hold down the shingles. Specifically, although conventional shovels may remove the shingles, the nails that once held the shingles often remain embedded in the roof.

Another problem suffered by conventional shingle removing shovels is the tendency for roofers to place the handle end of the shovel against their abdomen to achieve better leverage. If the shovel stops suddenly (e.g., when hitting an embedded nail), the entire impact of the shovel's stoppage is driven into that small portion of the roofer's abdomen that positioned against the shovel handle, which can cause discomfort.

Conventional shovels (both rounded and flat bladed) also lack the adaptability often needed by roofers in certain situations. For example, if a roofer is working in a narrow location, the fixed width of the shovel may be too wide for such a location. As a result, the roofer would be forced to create an on-the-spot work-around solution. Similarly, the length of the shovel may be unnecessarily long or too short for certain tasks such as when working on a ladder and/or when removing a gutter.

In addition to the foregoing, conventional shovels have also been proven deficient when used to remove shingles attached to sheathing clipped to plywood. Specifically, the shovels often engage, and possibly damage, the clips that hold the sheathing to the plywood.

Therefore, an apparatus is needed that addresses at least one, if not more, of the deficiencies that afflict conventional shingle removal shovels. More particularly, the need exists for a tool that facilitates and improves shingle removal.

SUMMARY

A shingle removing tool includes a shaft, a handle connected to a first end of shaft, and a base connected to a second end of the shaft. The base, the shaft, and/or the handle may be adjustable in length to enable a user to adjust the length of the tool in response to certain operating conditions. Further, the base and/or the handle may be releasably connected to the shaft so that different combinations of handles and bases may be employed in response to certain operating conditions. The base includes a blade portion, which may be serrated, that is configured to facilitate removal of shingles. The base may also include a scraper, a kick plate, and/or one or more rolling members. The rolling members may serve as a fulcrum upon which roofing materials may be pried from an underlying support structure.

An embodiment of the present invention addresses a shingle removing tool that includes, among other possible things, a handle, a shaft connected to the handle, and a base connected to the shaft. A length of the shaft is adjustable. The base includes a blade portion that is configured to separate one or more shingles from a support structure to which the shingles are affixed.

These and other features, aspects, and advantages of the invention will become more apparent from the following description, appended claims, and accompanying exemplary embodiments shown in the drawings.

DETAILED DESCRIPTION

Figure 1:
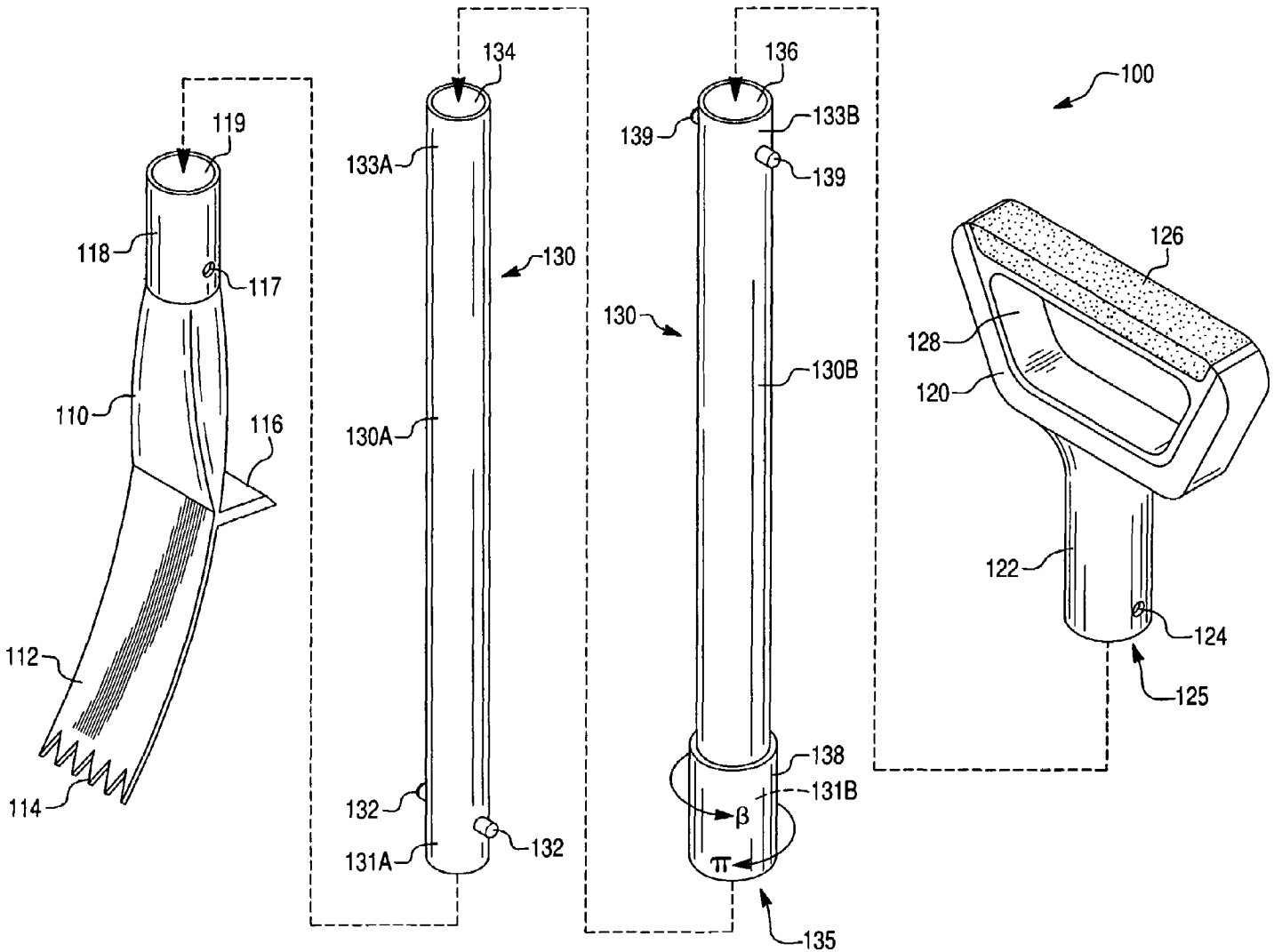
FIG. 1 is an exploded, perspective view of a shingle removing tool according to the invention.

Presently preferred embodiments of the invention are illustrated in the drawings. An effort has been made to use the same, or like, reference numbers throughout the drawings to refer to the same or like parts.

As hereafter described, a shingle removing tool generally includes a base, a shaft, and a handle. Both the base and the handle are connected to the shaft. At least one of the base, shaft, and handle may be adjustable in one or more dimensions. By enabling, for example, the shaft to be adjustable in height, the shingle removing tool is, unlike conventional shingle removal shovels, adaptable to certain operating conditions.

FIGS. 1 and 2A-2C show a shingle removing tool 100 that includes a base 110, a shaft 130, and a handle 120. The base 110 includes a blade portion 112 that is configured to separate one or more shingles from a support structure to which the shingles are affixed. A surface of the blade portion 112 can be curved to enhance the leverage available to a user. The blade portion 112 can include a kick plate in the form of a scraper 116 that increases a user's ability to pivot the blade portion 112 when prying, e.g., roofing material off of an underlying support structure (e.g., plywood or other material). The kick plate/scraper 116 can also be used to scrape a roof to remove nails and debris that may not be upwardly pried by the blade portion 112. The blade portion 112 also includes a thin, working edge 114 that is configured to be operable in narrow spaces. As shown, the edge 114 may be serrated and substantially flat to facilitate a user's ability to pry nails, clips, and other roofing materials away from an underlying support structure.

As shown, the shaft 130 may be formed of first and second telescoping shaft members 130A, 130B. The first shaft member 130A has a first end 131A and a second end 133A, and the second shaft member 130B has a first end 131B and a second end 133B. The first end 131A of the first shaft member 130A is configured to releasably connect to the base 110. In this regard, the base 110 has an engaging collar 118 that is configured to receive the first end 131A of the first shaft member 130A. Specifically, the collar 118 includes a shaft-receiving hole 119 and two spring-actuated pin-receiving holes 117 (one of which is shown). The spring-actuated pin-receiving holes 117 are configured to receive spring-actuated pins 132 that outwardly project from the first shaft member 130A of the shaft 130. In other words, when the first end 131A of the first shaft member 130A is journalled into the shaft-receiving hole 119, the spring-actuated pins 132 will initially be compressed into an interior 134 of the shaft member 130A from which they project. Then, when the spring-actuated pins 132 align with the corresponding pin-receiving holes 117, the pins 132 will outwardly spring into the holes 117. As a result, the base 110 will be releasably connected to the first shaft member 130A of the shaft 130.

The second end 133A of the first shaft member 130A is configured to be journalled into a hole 135 in the first end 131B of the second shaft member 130B. As the second shaft member 130B is hollow, the second shaft member 130B is freely adjustable with respect to the first shaft member 130A. In other words, the second shaft member 130B may be moved between (a) a least extended position at which the entire first shaft member 130A is housed within the second shaft member 130B (e.g., the second shaft member 130B is adjacent the collar 118 of the base 110) and (b) a most extended position at which only a small portion of the second end 133A of the first shaft member 130A is housed within the second shaft member 130B.

To fix the spatial relationship between the first and second shaft members 130A, 130B, a locking device such as a tightening clamp 138 may provided on the second shaft member 130B. By turning the clamp 138 in a first (e.g., clockwise) direction $\pi$, the clamp 138 may clamp onto a portion of the first shaft member 130A immediately adjacent the second shaft member 130B. As a result, the first and second shaft members 130A, 130B will be immobilized with respect to each other. Correspondingly, by turning the clamp 138 in an opposite, second (e.g., counterclockwise) direction $\beta$, the clamp 138 may release the portion of the first shaft member 130A immediately adjacent the second shaft member 130B. As a result, the first and second shaft members 130A, 130B will then be able to move relative to each other.

As a result of the telescoping nature of the shaft members 130A, 130B and the ability to fix the spatial position of the second shaft member 130B with respect to the first shaft member 130A, the overall length of the shaft 130 may be adjusted in response to certain operating conditions. More specifically, the length of the shaft 130 may be adjusted, e.g., in response to the height and reach of a particular user, the degree to which the user desires to bend, the pitch of a roof on which the user will use the tool 100, etc. If, for example, a user were standing atop a ladder and using the tool 100, the user may choose to position the second shaft member 130B in the least extended position (FIG. 2A), to position the tool's center of gravity closer to the user and reduce the likelihood that the user will be pulled off balance by the tool 100. In other situations, such as when the user is prying shingles off of a flat roof on which a user is standing, the user may opt to position the second shaft member 130B in the most extended position to maximize the leverage that can be attained by the user. Further, in other situations, the user may opt to position the second shaft member 130B in an intermediate position (FIG. 2B) with respect to the first shaft member 130A.

The handle 120 can be releasably connected to the shaft 130. For example, the handle can be releasably connected to the second end 133B of the second shaft member 130B. The second end 133B of the second shaft member 130B may include spring-actuated pins 139. These spring-actuated pins 139 are designed to be received by pin-receiving holes 124 in a collar 122 of the handle 120. In other words, when the second end 133B of the second shaft member 130B is journalled into a shaft-receiving hole 125 formed in the collar 122 of the handle 120, the spring-actuated pins 139 will initially be compressed into an interior 136 of the shaft member 130B. Then, when the spring-actuated pins 139 align with the corresponding pin-receiving holes 124, the pins 139 will outwardly spring into the holes 124. As a result, the handle 120 will be releasably connected to the second shaft member 130B of the shaft 130.

Figure 2A:
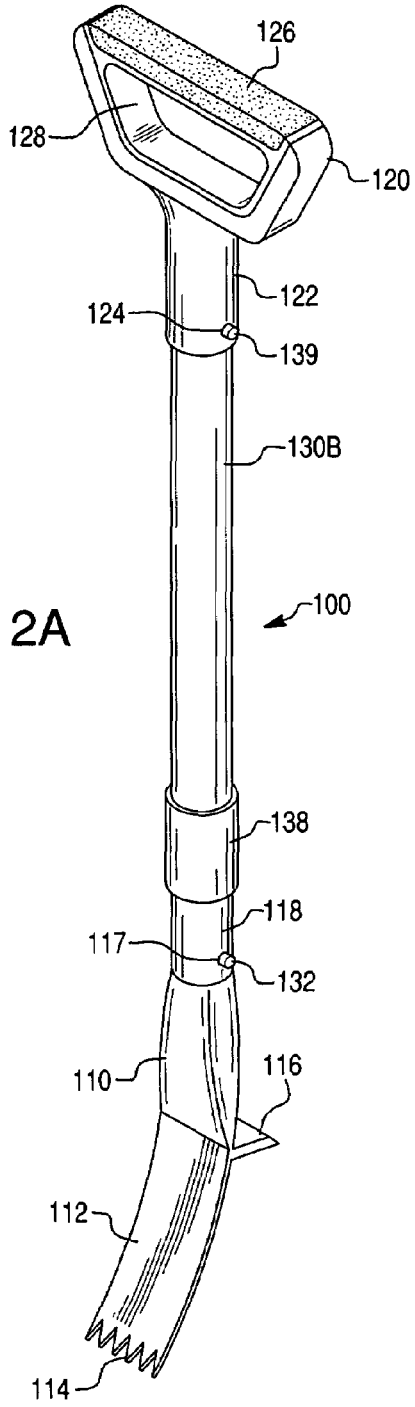
FIGS. 2A and 2B are assembled, perspective views of the shingle removing tool shown in FIG. 1 in a least extended position and in an intermediate position, respectively.
Figure 2B:
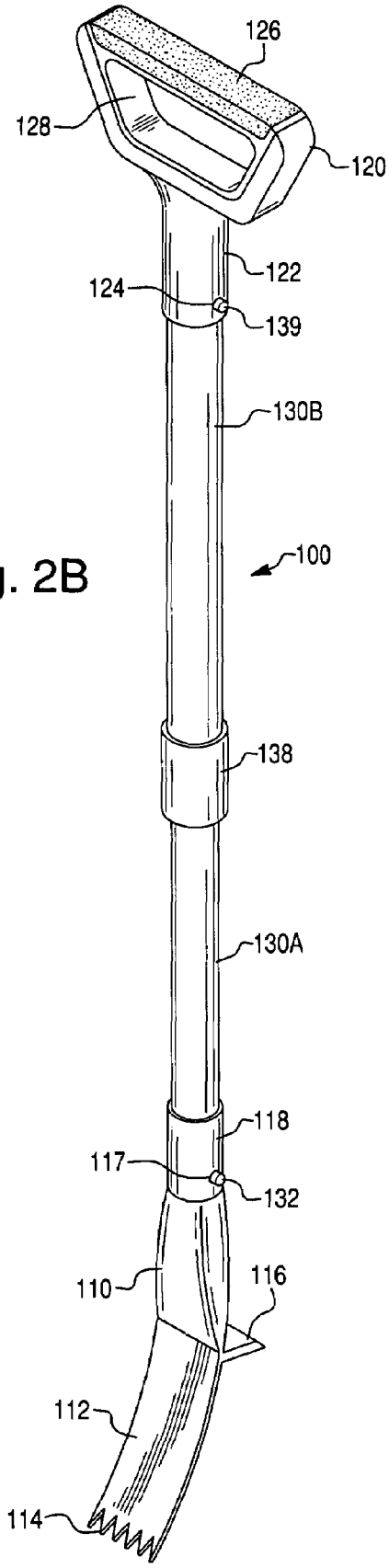
Figure 2C:
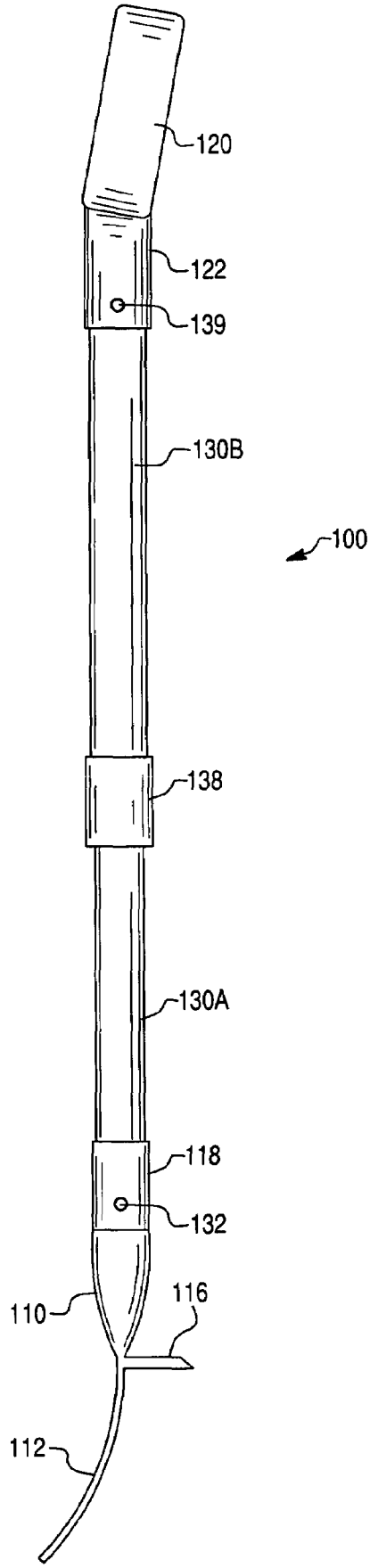
FIG. 2C is a side elevation view of the assembled shingle removing tool shown in FIG. 2B.

The handle 120, which as shown in FIG. 2C may be tilted at an angle with respect to the shaft 130, has a window 128 through which a user may place his fingers when grasping the handle 120. In addition, to enhance the user's comfort, a grip 126 may be provided along an outer rim of the handle that will abut the user's palm when grasping the handle 120.

Figure 3:
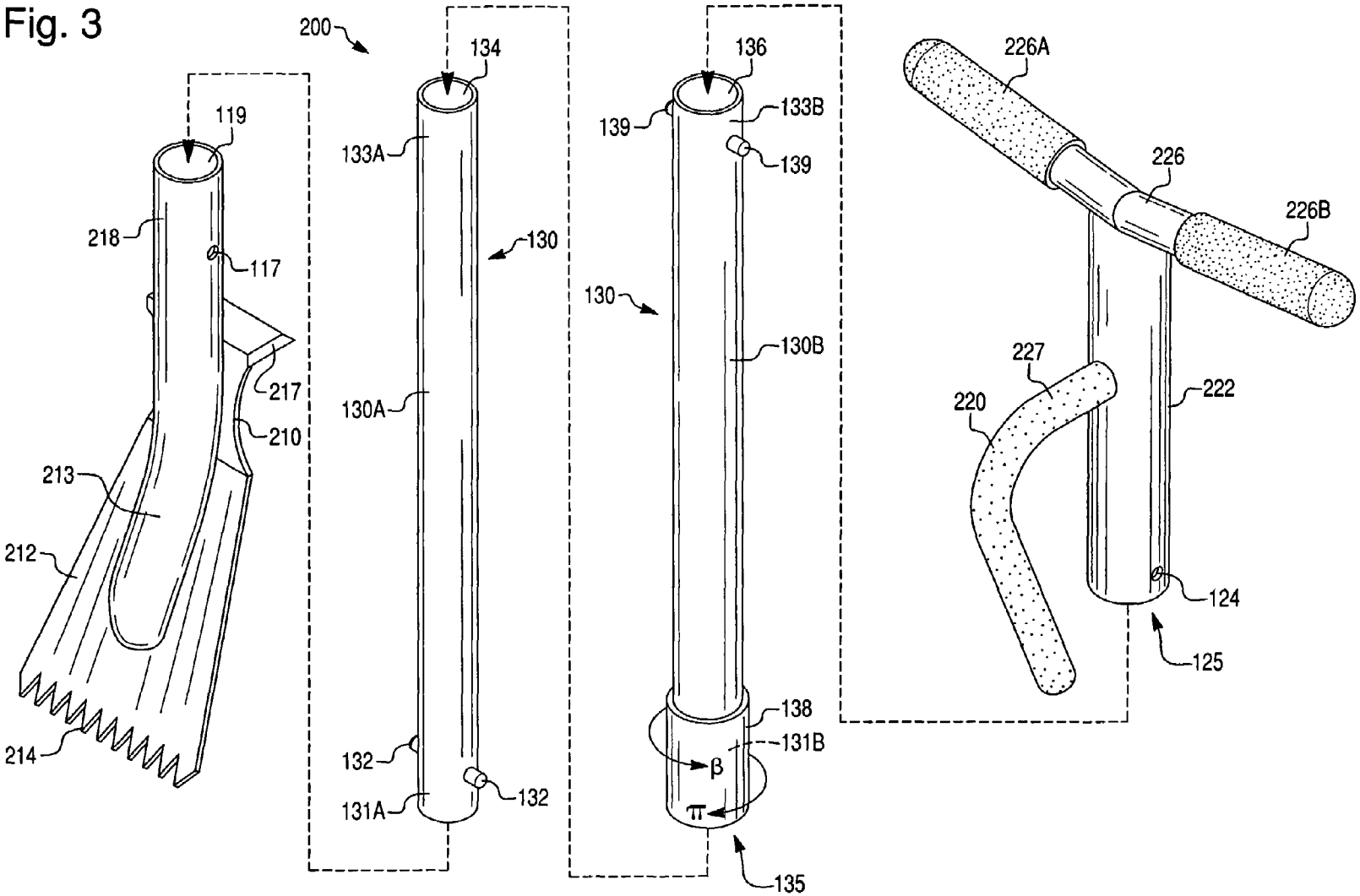
FIG. 3 is an exploded, perspective view of another shingle removing tool.
Figure 4A:
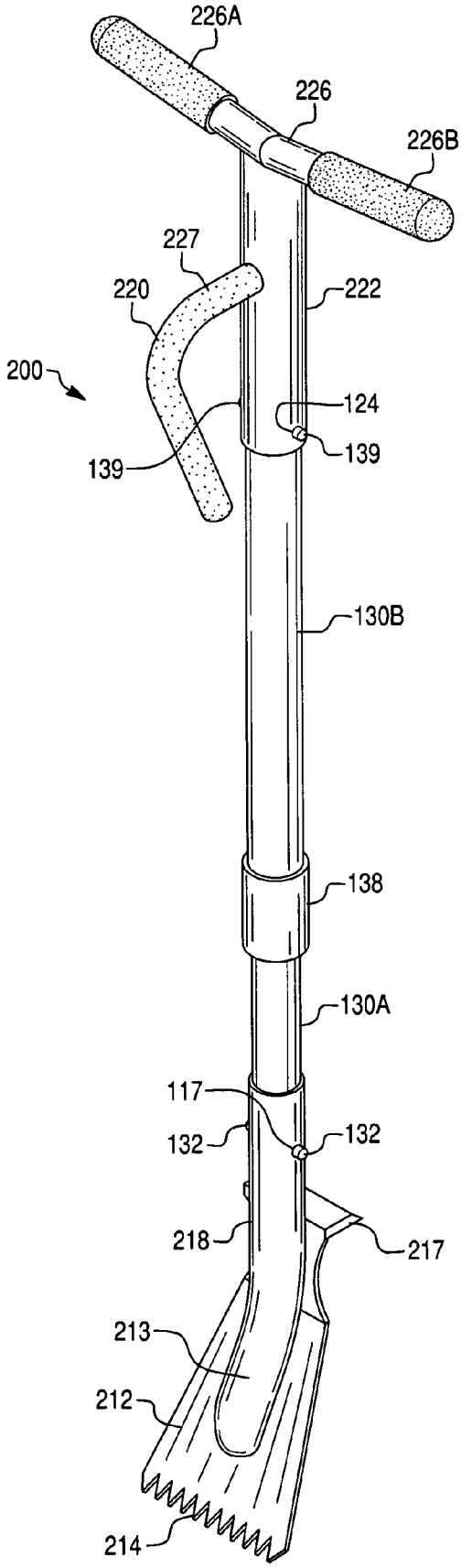
FIG. 4A is an assembled, perspective view of the shingle removing tool shown in FIG. 3.
Figure 4B:
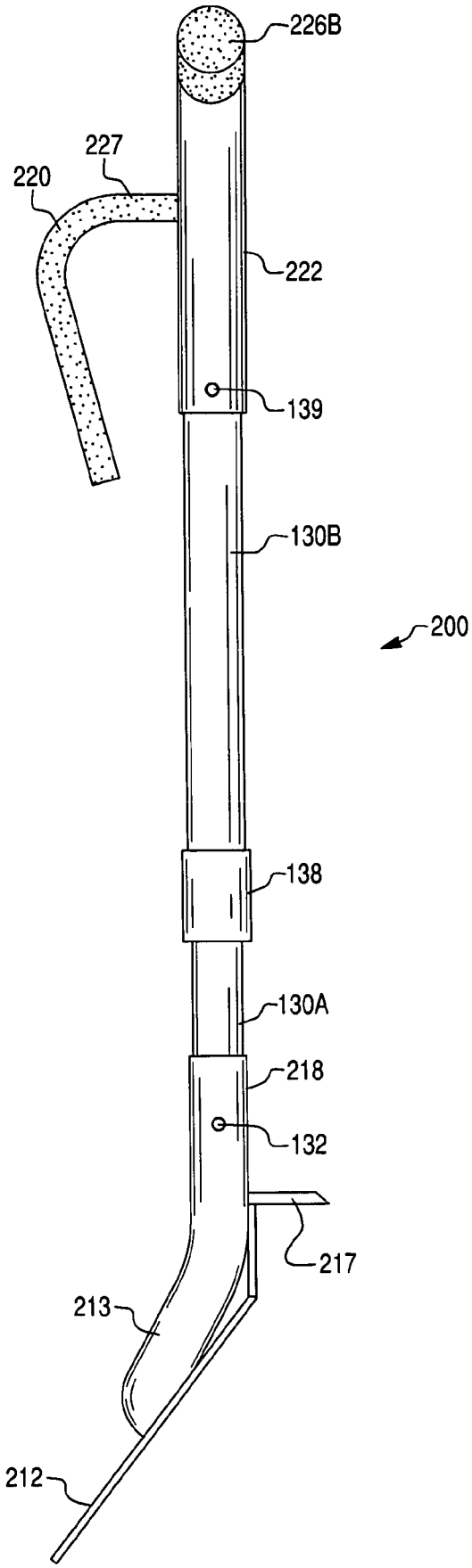
FIG. 4B is a side elevation view of the assembled shingle removing tool shown in FIG. 4A.
Figure 5:
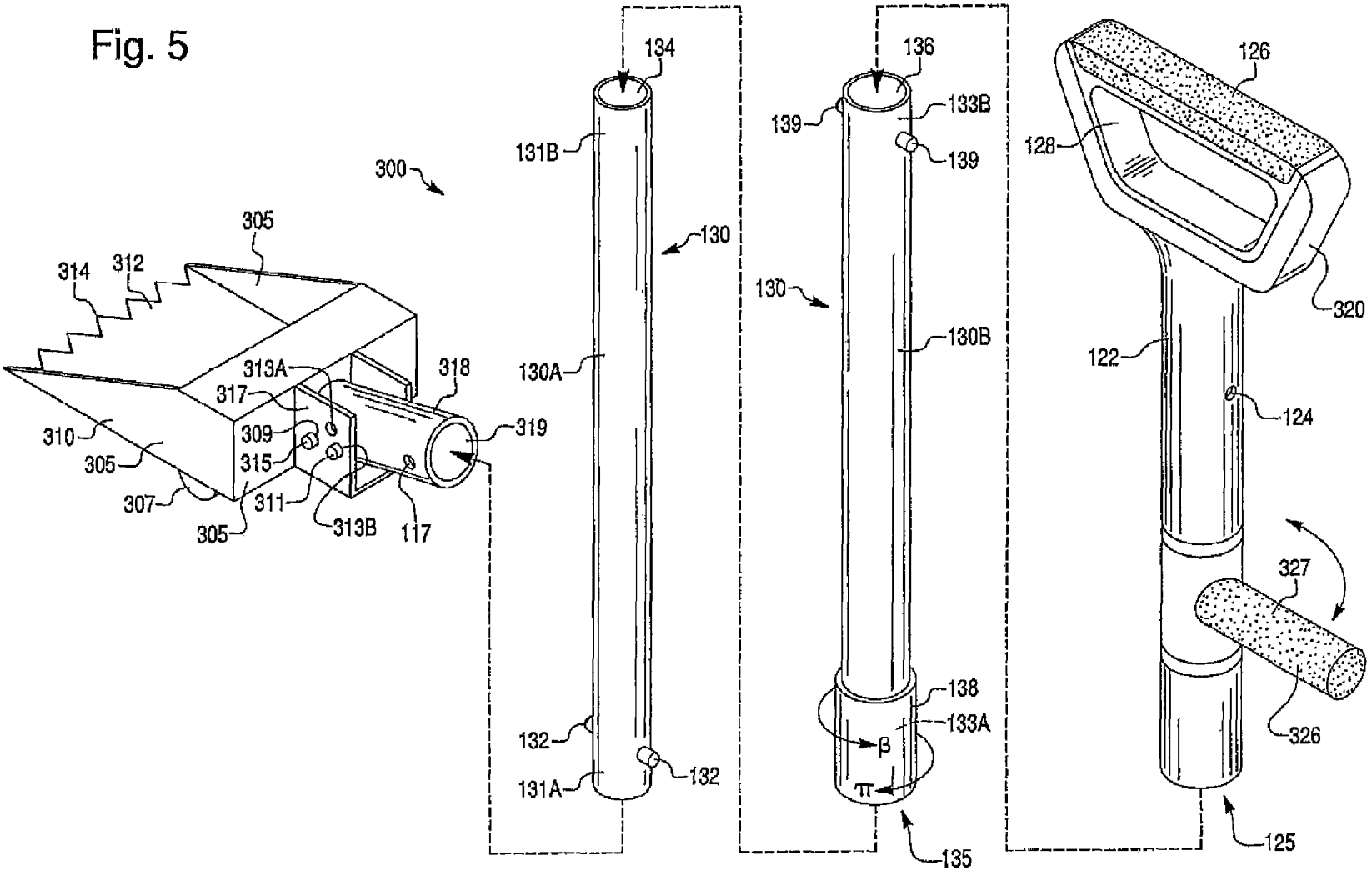
FIG. 5 is an exploded, perspective view of yet another shingle removing tool.
Figure 6:
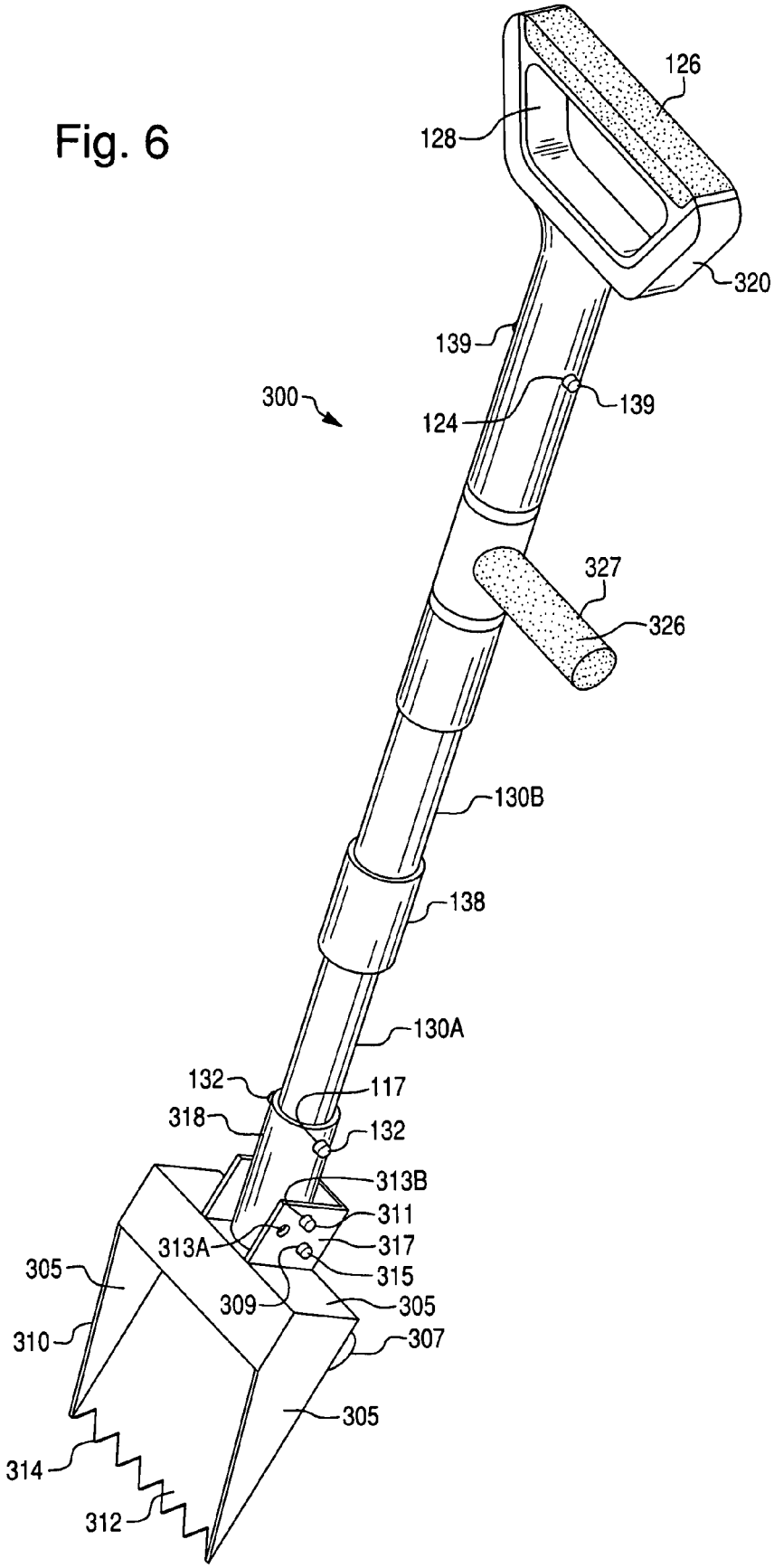
FIG. 6 is an assembled, perspective view of the shingle removing tool shown in FIG. 5.

FIGS. 3, 4A, and 4B show another shingle removing tool 200. The shaft 130 of this tool 200 is the same as that of the previously described tool 100. Accordingly, a duplicative discussion will be omitted.

This tool 200 includes a base 210 that has a wide blade portion 212 and serrated working edge 214. In addition, the blade portion 212 of this tool 200 is generally planar. To inhibit any unwanted bending of the blade portion 212, a reinforcing support 213 (which may, as shown, be tubular in shape) may extend from a base collar 218 to a central position of the blade portion 212. The base 210 may also include a kick plate in the form of a scraper 217 on which a user may rest one foot when using the tool 200 in a manner similar to a shovel. The kick plate/scraper 217 may provide additional leverage when the blade portion 212 of the base 210 becomes wedged between two items such as a piece of roofing material and an underlying support structure.

This tool includes a first handle 220 and a second (or auxiliary) handle 226. The first handle 226 may, as shown, include two grips 226A, 226B. The first handle 226 in conjunction with a collar 222 forms a "Y" or a "T" shape that balances the blade portion 212 and increases efficiency. The "T" or "Y" shape of the first handle 226 is configured to span a user's abdomen. As a result, the user may push the tool 200 either with the user's two hands respectively on the grips 226A, 226B or with the user's abdomen against the grips 226A, 226B. When the user places the grips 226A, 226B against his abdomen, pressure associated with a sudden stoppage of the tool 200 is distributed over a wider area of the user's abdomen as compared to the conventional shovel previously discussed.

The second handle 220, which can be somewhat "U" or "C" shaped, may also include a grip 227. This handle 220 initially extends outward from a first position on the collar 222 and then extends towards a second position on the shaft 130, as shown in FIG. 4. The second handle 220 may be used in conjunction with one or both of the other grips 226A, 226B. For example, a user may push the tool 200 with his abdomen positioned against the grips 226A, 226B of the second handle 226 while steadying the tool by holding (with a hand) the first handle 220. Further, while manipulating the tool 200 with both of the handles 220, 226 in this manner, the second handle 220 facilitates prying roofing materials off of an underlying support structure by reducing the degree to which the user must bend to obtain sufficient leverage.

FIGS. 5, 6, 7A and 7B show yet another shingle removing tool 300. The shaft 130 of this tool 300 is the same as that of the previously described tools 100, 200. Accordingly, a duplicative discussion will be omitted.

This tool 300 includes a base 310 that is in the form of a dustpan. The pan shape of the base 310 facilitates collection of roofing materials. The base 310 has a wide blade portion 312 and corresponding serrated working edge 314. The blade portion 312 of this base 310 may be supported by sidewalls 305, as shown.

The base 310 of this tool 300 may include rolling members such as wheels 307 (one of which is shown) that may, as shown, be recessed into a surface of the base 310 opposite the edge 314. The wheels 307, which are designed to ensure easy operation and to reduce exertion, may serve as a fulcrum upon which a user may pry roofing or other material off of an underlying support structure. Moreover, the wheels 307 enable the base 310 to roll over certain items such as roofing clips much more readily than the conventional tools previously discussed. As a result, the wheels 307, in conjunction with the angle at which the base 310 is applied to a roofing surface, reduce the likelihood that roofing clips and other such items will be damaged by the base 310.

Figure 7A:
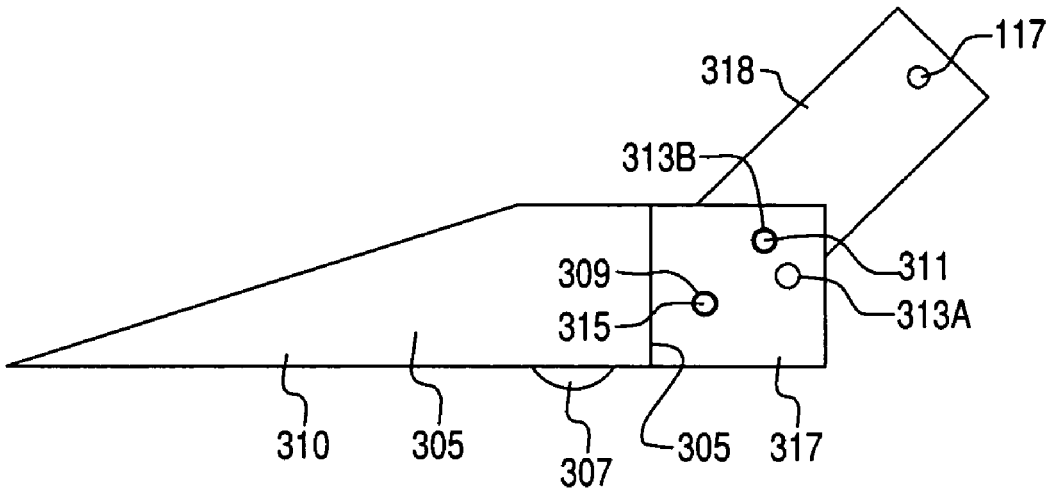
FIGS. 7A and 7B are side elevation views of a base of the shingle removing tool shown in FIG. 5 with a base collar fixed in first and second positions, respectively.
Figure 7B:
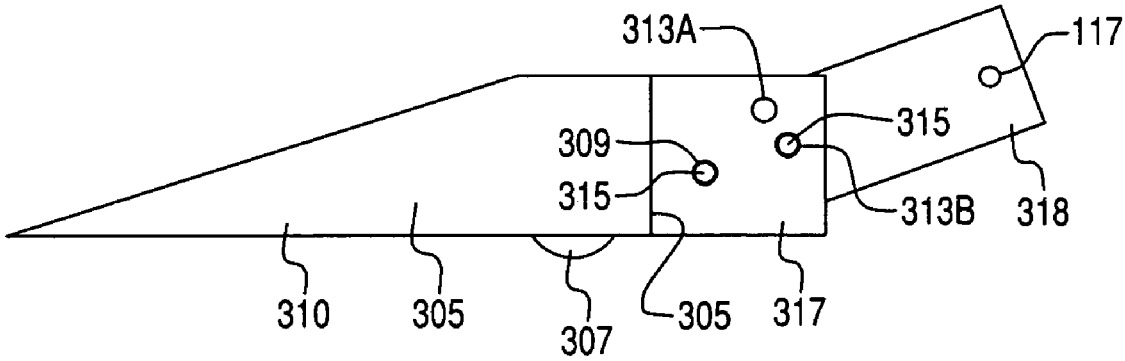

The base 310 also includes a pivotal attachment 317 that enables a collar 318 of the base 310 to move between first (FIG. 7A) and second (FIG. 7B) positions. The collar 318 contains an axle 315 that extends through an interior 319 of the collar 318 and that projects through holes 309 (one of which is shown) formed in opposite sides of the pivotal attachment 317. The collar 318 is configured to rotate with respect to the pivotal attachment 317 by means of the axle 315 through the collar 318 and the holes 309. To limit the rotation of the collar 318 with respect to the pivotal attachment 317, two spring-actuated pins 311 (one of which is shown) outwardly project from the collar 318. The two spring-actuated pins 311 are configured to be received in either of two corresponding pairs of holes 313 (one hole 313 of each of the two pairs is shown) formed in the opposite sides of the pivotal attachment 317. For example, the pins 311 may be received in a first pair of holes 313A (as shown in FIG. 7A) or in a second pair of holes 313B (as shown in FIG. 7B). When the pins 311 are received in the first pair of holes 313A, the shaft 130 will be oriented at a greater angle with respect to the blade portion 312 than when the pins 311 are received in the second pair of holes 313B.

This tool 300 includes a first handle 320 and a second (or auxiliary) handle 326. The first handle 320 includes a singular finger window 128 and a hand grip 126. The second handle 326, which may also include a grip 327, is configured to rotate 360° around an axis defined by the shaft 130. As a result, the second handle 326 may be configured for right-hand and left-hand use to provide additional leverage to both right-handed and left-handed users. Further, the second handle 326 may be freely rotatable about the axis defined by the shaft 130 or may be adjustable into a plurality of positions around the shaft 130 at which the handle 326 may be releasably locked.

In tools 100, 200, 300, the bases 110, 210, 310, shafts 130, and handles 120, 220, 226, 320, 326 (except for the grips 126, 226A, 226B, 227, 327) may all be formed of the same type of material such as steel, Further, the handles 120, 220, 226, 320, 326 (except for the grips 126, 226A, 226B, 227, 327) and the shafts 130 may be formed of a first type (e.g., ten gauge) of steel whereas the bases 110, 210, 310 may be formed of a stronger, second type (e.g., fifteen gauge) of steel. The grips 126, 226A, 226B, 227, 327 may be formed of, e.g., foam, rubber or other elastomer, a soft polymer, or other soft and/or cushiony material.

The invention is not restricted to the embodiments of the invention previously described. It will be apparent to those skilled in the art that various modifications and variations can be made to the disclosed embodiments of the invention without departing from the scope or spirit of the invention.

For example, although particular bases were described in conjunction with particular handles, these pairings are not required. Therefore, a user may, within the scope of the invention, mix-and-match any base with any handle.

By way of further example, although the connectivity among the shaft, base, and handle were described as being releasable, such releasable engagement is not required. Therefore, other embodiments that contemplate a more permanent connectivity among the shaft, base, and/or handle are also fully within the scope of the invention.

By way of yet another example, the means by which the base collar 318 in the third tool 300 is adjusted could be altered. For example, the adjustment could be performed by a series of screws positioned above and below the collar such that if one screw (e.g., below the collar 318) is screwed into the pivotal attachment 317, whereas another screw (e.g., above the collar 318) is screwed out of the pivotal attachment 317, the collar 318 will move toward the screw that is being screwed out of the pivotal attachment 317. Of course, other means such as additional sets of pin-receiving holes in the pivotal attachment 317 could also be used. Therefore, each of these alternative means of collar adjustment are fully within the scope and spirit of the instant invention.

Similarly, the means by which the length of the base, shaft, and/or handle(s) is adjusted is not limited to telescoping members. For example, a first length-adjusting member could slide adjacent a second length-adjusting member. Moreover, even if the length of the base, shaft, and/or handle(s) is adjusted using telescoping members, there are many other means by which the telescoping shaft members can be immobilized with respect to each other. For example, a pair of spring-actuated pins may project from a first telescoping member and may be configured to be received in a plurality of pairs of pin-receiving holes formed in a second telescoping member. Each of these alternative length adjusting means is within the scope and spirit of the instant invention.

Accordingly, these other shingle removing tools are fully within the scope of the claimed invention. Therefore, it should be understood that the previously described devices are illustrative only and are not limiting upon the scope of the invention, which is indicated by the following claims.

What is claimed is:

1. A shingle removing tool comprising:

a handle;

a shaft connected to the handle; and a base connected to the shaft, wherein the shaft is formed of an outer member and a telescoping inner member receivable in the outer member that enables the length of the shaft to be freely adjusted to any length between a maximum extended position and a minimum extended position;

wherein a length of the shaft is adjustable and fixed by rotating a tightening clamp about the shaft and the tightening clamp contacting the telescoping inner member and the outer member at a tightened, locked length of the shaft, wherein the base comprises;

a blade portion that is configured to separate one or more shingles from a support structure to which the shingles are affixed;

inclined sidewalls rising perpendicular to the blade portion on opposite edges of the base; a rear wall rising perpendicular to and opposite the blade portion, the rear wall being coupled to the sidewalls; and one or more rolling members enclosed by a recessed opening of the blade portion, and wherein the sidewalls and the rear wall are positioned outside of and adjacent to the rolling members to form a portion of the recessed opening.

2. The shingle removing tool according to claim 1, wherein the handle is T-shaped or Y-shaped.

3. The shingle removing tool according to claim 1, wherein the one or more rolling members are provided on an end of the base opposite an edge of the blade;

wherein the one or more rolling members are positioned to create a fulcrum that enables an operator to raise the blade by lowering the handle.

4. The shingle removing tool according to claim 1, wherein the shaft is movably connected to the base such that the shaft is movable between at least a first position and a second position, and wherein the shaft is configured to be fixed relative to the base in at least the first and second positions.

5. The shingle removing tool according to claim 1, further comprising:

an auxiliary handle connected to at least one of the shaft the handle; wherein the auxiliary handle is adjustable for right-hand use and left-hand use.

6. The shingle removing tool according to claim 1, wherein the blade has a serrated edge.

7. A shingle removing tool comprising:

a shaft;

a collar releasably coupled to the shaft;

first and second handles distinct from the shaft, wherein the first handle is formed on the collar and the second handle is formed on the collar; and a base connected to the shaft, wherein the second handle is adjustable for right-hand use and left-hand use; and extends outward from a first point on the shaft or on the handle, and wherein the base comprises:

a blade portion that is configured to separate one or more shingles from a support structure to which the shingles are affixed;

inclined sidewalls rising perpendicular to the blade portion on opposite edges of the base;

a rear wall rising perpendicular to and opposite the blade portion, the rear wall being coupled to the sidewalls; and one or more rolling members enclosed by a recessed opening of the blade portion, and wherein the sidewalls and the rear wall are positioned outside of and adjacent to the rolling members to form a portion of the recessed opening.

8. The shingle removing tool according to claim 7, wherein the handle is T-shaped or Y-shaped.

9. The shingle removing tool according to claim 7, wherein the base comprises one or more rolling members; wherein the one or more rolling members are provided on an end of the base opposite an edge of the blade;

wherein the one or more rolling members are positioned to create a fulcrum that enables an operator to raise the blade by lowering the handle.

10. The shingle removing tool according to claim 7, wherein the blade has a serrated edge.

11. A shingle removing tool comprising:

a handle;

a shaft connected to the handle; and a base connected to the shaft, wherein the base comprises:

a blade portion that has a serrated edge that is configured to separate one or more shingles from a support structure to which the shingles are affixed;

one or more rolling members that are configured to reduce wear to the base and to serve as a fulcrum and are enclosed by a recessed opening of the blade portion;

inclined sidewalls rising perpendicular to the blade portion on opposite edges of the base; and a rear wall rising perpendicular to and opposite the blade portion, the rear wall being coupled to the sidewalls; and wherein the one or more rolling members are provided on an end of the base opposite the edge of the blade, and wherein the sidewalls and the rear wall are positioned outside of and adjacent to the rolling members to form a portion of the recessed opening.

12. The shingle removing tool according to claim 11, wherein the handle is T-shaped or Y-shaped.

13. The shingle removing tool according to claim 11, wherein the one or more rolling members are positioned to create a fulcrum that enables an operator to raise the blade by lowering the handle.

14. The shingle removing tool according to claim 11, wherein the shaft is movably connected to the base such that the is movable between at least a first position and a second position, and wherein the shaft is configured to be fixed relative to the base in at least the first and second positions.

15. The shingle removing tool according to claim 11, further comprising:

an auxiliary handle connected to at least one of the shaft the handle;

wherein the auxiliary handle is adjustable for right-hand use and left-hand use.

* * * * *